United States Patent [19]

Staerzl

[11] Patent Number: 4,964,385

[45] Date of Patent: Oct. 23, 1990

[54] ENGINE OVERSPEED CONTROL

[75] Inventor: Richard E. Staerzl, Fond du Lac, Wis.

[73] Assignee: Brunswick Corporation, Skokie, Ill.

[21] Appl. No.: 460,646

[22] Filed: Jan. 3, 1990

[51] Int. Cl.[5] ..... F02P 11/02

[52] U.S. Cl. ..... 123/335; 123/198 DC

[58] Field of Search ..... 123/334, 335, 198 D, 123/198 DC, 418, 630, 644

[56] References Cited

U.S. PATENT DOCUMENTS

| | | | |
|---|---|---|---|
| 3,738,340 | 6/1973 | Olson | 123/335 |
| 4,015,564 | 4/1977 | Fitzner | 123/602 |
| 4,252,095 | 2/1981 | Jaulmes | 123/335 X |
| 4,462,356 | 7/1984 | Hirt | 123/335 |
| 4,594,978 | 6/1986 | Kanno | 123/335 |
| 4,625,689 | 12/1986 | Komurasaki | 123/335 |
| 4,776,311 | 10/1988 | Venieres et al. | 123/335 |
| 4,919,091 | 4/1990 | Wissmann et al. | 123/198 DC |

*Primary Examiner*—Willis R. Wolfe

*Attorney, Agent, or Firm*—Andrus, Sceales, Starke and Sawall

[57] ABSTRACT

In a multicylinder internal combustion engine, an overspeed control circuit progressively cuts out ignition to the cylinders depending upon the amount the threshold is exceeded. A monostable multivibrator is set by the ignition pulse of a given cylinder to initiate a given timing interval of fixed duration. A charging capacitor circuit has a first capacitor charged by the output of the monostable multivibrator during the timing interval, and discharged during a second timing interval until the next ignition pulse of the given cylinder. A latching comparator is set by the ignition pulse of the given cylinder and disables a cut-out switch which in turn permits ignition pulses to the cylinders. A second capacitor is also charged during the first timing interval until it reaches a given threshold voltage, corresponding to a given engine threshold speed, and which resets the latching comparator, which in turn actuates the cut-out switch to cut out ignition pulses to the remaining cylinders. As engine speed increases, the ignition pulses of the given cylinder become closer in time, and the second timing interval becomes a lesser fraction of the time between ignition pulses of the given cylinder, such that the discharge time of the first capacitor becomes shorter, and the voltage on the first and second capacitors begins to increase along a positive slope ramp from a higher minimum, such that the voltage on the second capacitor reaches the threshold voltage at an earlier time following the ignition pulse of the given cylinder.

17 Claims, 2 Drawing Sheets

ENGINE SPEED BELOW THRESHOLD

ENGINE SPEED AT THRESHOLD

ENGINE SPEED ABOVE THRESHOLD

ENGINE OVERSPEED CONTROL

BACKGROUND AND SUMMARY

The invention arose during development efforts directed toward providing a soft overspaced control for a two-cycle internal combustion engine, including a marine drive.

The invention prevents a two-cycle internal combustion marine engine from overspeeding by controlling the ignition. When a speed threshold is reached, the invention will progressively kill the ignition to the cylinders depending upon the amount the threshold is exceeded.

DETAILED DESCRIPTION

Figure 1:
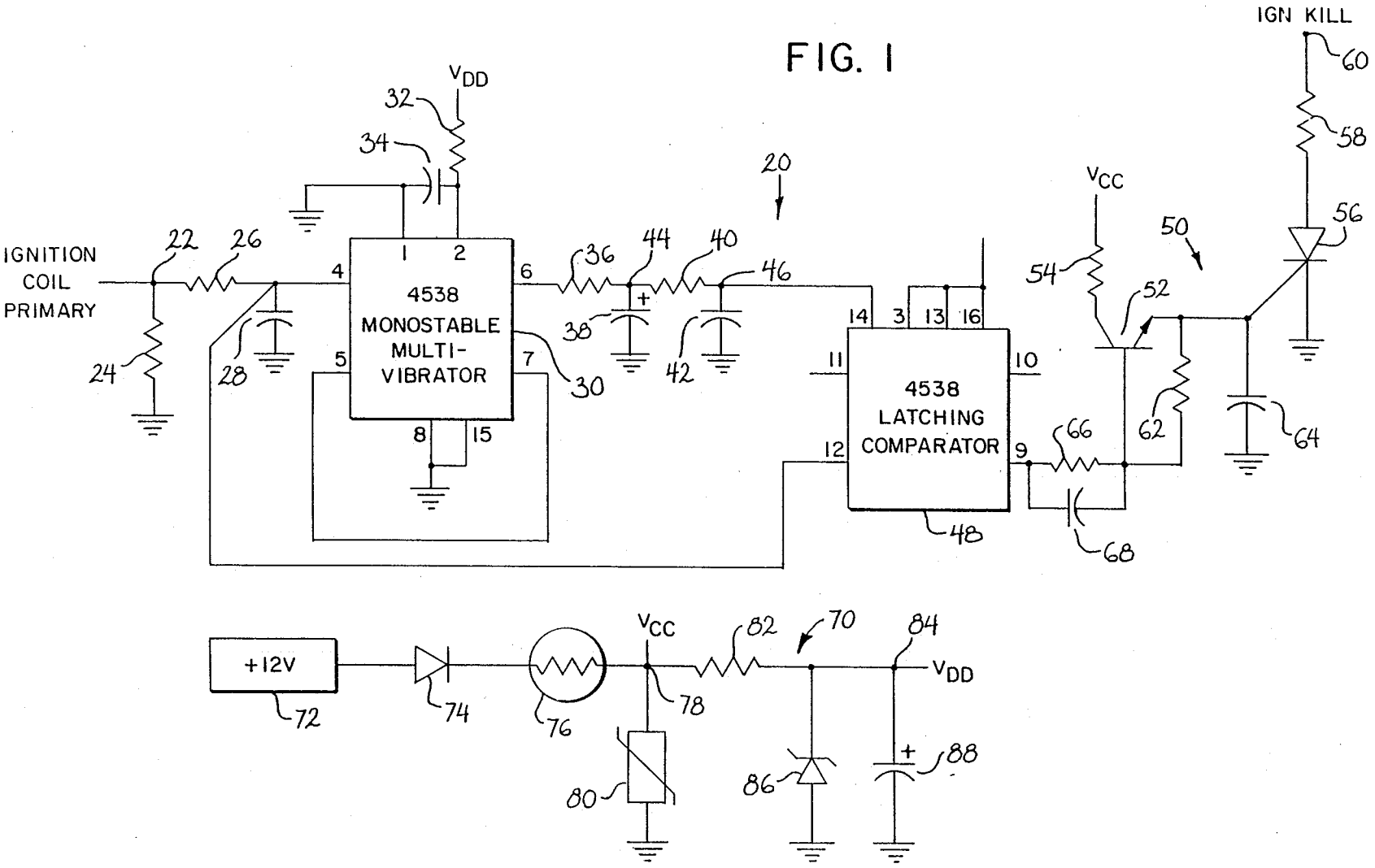
FIG. 1 is a circuit diagram showing an overspeed control circuit in accordance with the invention.

FIG. 1 shows an overspeed control circuit 20 for a multicylinder internal combustion engine having an ignition circuit supplying ignition pulses at an ignition coil primary lead 22 of a given cylinder having a ground reference through resistor 24, for which further reference may be had to U.S. Pat. No. 4,015,564, incorporated herein by reference. The ignition pulse voltage is reduced by resistor 26, and filtered by capacitor 28, and input to a monostable multivibrator 30 provided by one-half of a 4538 dual precision monostable multivibrator chip, where manufacturer assigned pin number designations are shown to facilitate understanding. The ignition pulse from lead 22 at input pin 4 sets monostable multivibrator 30 such that output pin 6 goes high and initiates a given timing interval T1, FIGS. 2–4, of fixed duration as determined by the RC timing circuit provided by resistor 32 and capacitor 34. Capacitor 34 is charged through resistor 32 from voltage source $V_{DD}$.

Resistor 36 and capacitor 38 are connected in series between output pin 6 of monostable multivibrator 30 and ground, such that capacitor 38 is charged through resistor 36 from output pin 6. Resistor 40 and capacitor 42 are connected in series from node 44 between resistor 36 and capacitor 38 and ground, such that capacitor 42 is charged through resistors 36 and 40 from output pin 6 of monostable multivibrator 30 and through resistor 40 from capacitor 38. Node 46 between resistor 40 and capacitor 42 is connected to the threshold input of a latching comparator 48 provided by the other half of the above noted 4538 dual precision monostable multivibrator chip, where manufacturer assigned pin number designations are shown to facilitate understanding.

Latching comparator 48 receives the noted ignition pulse of the given cylinder from lead 22 at input pin 12 and is set thereby such that output pin 9 goes low. A cut-out switch 50 responds to the set state of latching comparator 48 and permits ignition pulses to the cylinders. Cut-out switch 50 includes a bipolar NPN transistor 52 which is nonconductive in response to the low state on output pin 9 of latching comparator 48, to in turn block current flow from voltage source $V_{CC}$ through resistor 54 to the gate of SCR 56, such that the latter is off, which in turn prevents a short circuit through resistor 58 from node 60, which would otherwise cut out or kill ignition pulses, as shown in incorporated U.S. Pat. No. 4,015,564 at the ignition kill switch.

Latching comparator 48 is also responsive to the voltage at node 46 provided by capacitors 38 and 42 and is reset thereby at input pin 14 when the voltage at node 46 reaches a given threshold voltage corresponding to a given engine threshold speed. When latching comparator 48 is reset, output pin 9 goes high, which in turn biases transistor 52 into conduction which in turn biases SCR 56 into conduction, which in turn completes a circuit through resistor 58 from node 60 to cut out ignition pulses to the remaining cylinders until occurrence of the next ignition pulse for the given cylinder. Resistor 62 prevents false dv/dt triggering of transistor 52, and capacitor 64 provides filtering. By sizing resistor 58, the ignition can be weakened, rather than killed. As used herein, cutting out ignition pulses means weakening or killing such pulses.

The gate circuit of cut-out switch 50 includes a resistor 66, and a speed-up capacitor 68 connected in parallel therewith and momentarily short circuiting resistor 66 upon resetting of latching comparator 48, such that the high state of output pin 9 immediately triggers the gate circuit to actuate cut-out switch 50 to an on state of SCR 56 to cut out ignition pulses to the remaining cylinders. The next ignition pulse at lead 22 sets comparator 48 at input pin 12 such that output pin 9 goes low.

A power supply 70 provides voltage sources $V_{CC}$ and $V_{DD}$ and is connected to the battery 72 of the engine. Current from the battery is rectified by diode 74 and passed through protective PTC thermis+or 76 which provides voltage $V_{CC}$ at node 78 which is regulated by MOV 80. Node 78 is connected through resistor 82 to node 84 which provides voltage $V_{DD}$ as regulated by zener diode 86 and filtered by capacitor 88.

Figure 2:
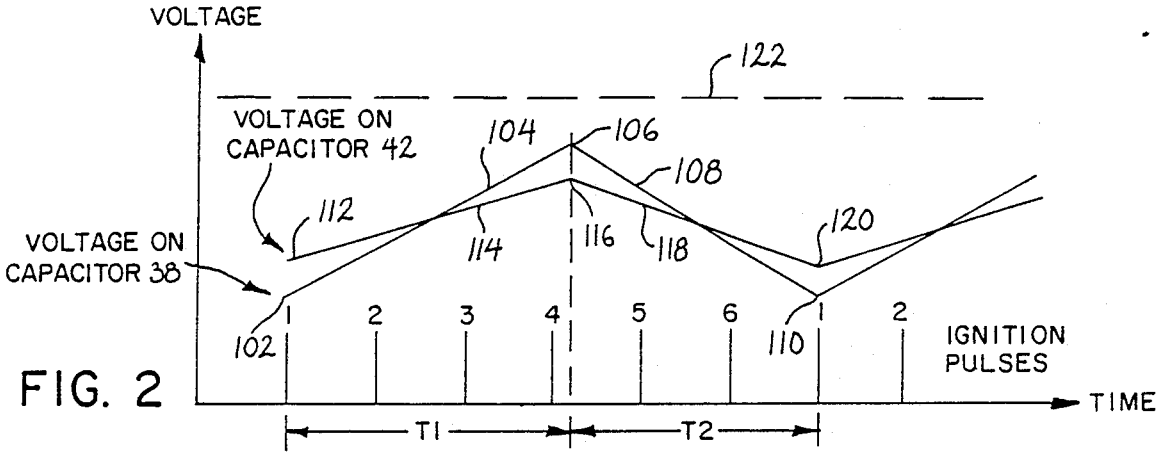
FIG. 2 is a graph illustrating circuit operation at engine speed below a given threshold.
Figure 3:
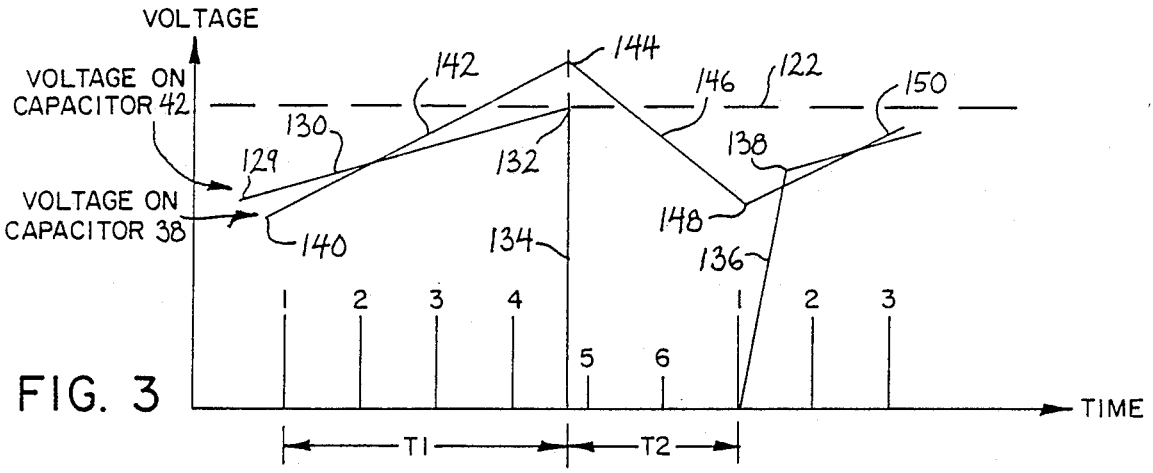
FIG. 3 is a graph illustrating circuit operation at engine speed at the given threshold.
Figure 4:
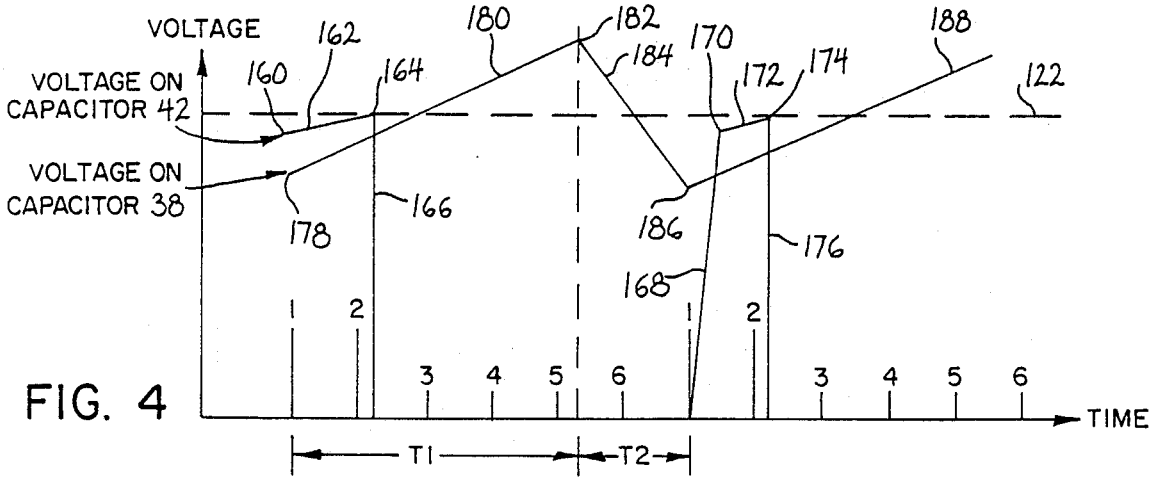
FIG. 4 is a graph illustrating circuit operation at engine speed above the given threshold.

Capacitor 38 is charged during the noted fixed timing interval T1, and is discharged during a second timing interval T2, FIGS. 2–4, following termination of interval T1, until the next ignition pulse for the given cylinder, such as the number one cylinder, at lead 22. The length of timing interval T1 is fixed by RC circuit 32, 34. The length of timing interval T2 is a function of engine speed. At the end of timing interval T1, when the charge on capacitor 34 reaches a given percentage of $V_{DD}$, output pin 6 goes low and output pin 7 goes high, which latter pin is connected to input pin 5 to reset monostable multivibrator 30 at the end of timing interval T1. During timing interval T2, monostable multivibrator 30 is in its reset state, and capacitor 38 slowly discharges through resistor 36 and pin 6 of monostable multivibrator 30 to ground. The voltage on capacitor 38 is shown in FIG. 2 rising from minimum point 102 along a positive slope ramp 104 to maximum point 106 during timing interval T1, and then decreasing along negative slope ramp 108 to minimum point 110 at the end of timing interval T2, which is the beginning of the next timing interval T1 at the ignition pulse of the number one cylinder. As engine speed increases, for example as shown in FIG. 3, the ignition pulses of the number one cylinder become closer together in time, and timing interval T2 becomes a lesser fraction of the time between ignition pulses of the number one cylinder, such that the discharge time of capacitor 38 becomes shorter.

During charging of capacitor 38 during timing interval T1, the voltage on capacitor 42 increases from minimum point 112, FIG. 2, along positive slope ramp 114 to a maximum at point 116, and then decreases along negative slope ramp 118 to minimum point 120 at the end of timing interval T2. The voltage across capacitor 42 is the voltage at node 46 which is sensed at input pin 14 of latching comparator 48. When the engine speed is below a given threshold speed, the voltage at input pin 14 does not rise above a given threshold voltage as shown at dashed line 122 in FIG. 2. Since the maximum voltage 116 on capacitor 42 does not reach threshold 122, latching comparator 48 is not reset, and hence output pin 9 remains low, and switch 50 does not cut out ignition pulses. This is shown in FIG. 2 with all ignition pulses 1–6 being present.

Resistor 36 is selected to be substantially smaller than resistor 40, and capacitor 38 is selected to be substantially larger than capacitor 42. In one embodiment, resistor 36 is 51 kilohms, resistor 40 is 510 kilohms, capacitor 38 is 1 microfarad, and capacitor 42 is 0.001 microfarad. These values are selected such that the voltage on capacitor 42 substantially tracks that on capacitor 38 but with less ripple. The lesser ripple is desired to reduce the voltage swing at pin 14 and enable quicker discharge thereof and faster response, to be described. The ripple must be great enough, however, to cross a given threshold, to be described. The voltage on capacitor 38 has greater swings and reaches greater peaks in order to quickly pull up the voltage on capacitor 42 when the latter is to be recharged following discharge thereof at resetting of latching comparator 48 and then setting thereof upon initiation of the next timing interval T1.

When the engine speed is at a given threshold speed, FIG. 3, the voltage on capacitor 42 at node 46 and pin 14 rises from minimum point 129 and increases along positive slope ramp 130 to maximum point 132 at voltage threshold 122. The voltage at pin 14 thus reaches the trip voltage and resets latching comparator 48 such that output pin 9 goes high which in turn triggers switch 50 into conduction which cuts out ignition pulses to the remaining cylinders, as shown at cut-out ignition pulses for the number five and six cylinders. Upon resetting of latching comparator 48, pin 14 immediately goes low, and capacitor 42 quickly discharges through pin 14 of latching comparator 48 to ground, which discharge is shown at 134 in FIG. 3. Latching comparator 48 is set by the next ignition pulse for the number one cylinder at pin 12, which disconnects pin 14 from ground and enables capacitor 42 to again begin charging, as shown at 136. Capacitor 42 quickly charges to the level of capacitor 38 and further to peak 138 due to high output pin 6 of monostable multivibrator 30. Capacitor 42 is thus ready to quickly reset latching comparator 48 as needed if the voltage on capacitor 42 at node 46 and pin 14 increases above threshold 122.

The voltage on capacitor 38 at node 44 rises from minimum point 140, FIG. 3, and increases along positive slope ramp 142 to maximum point 144 at the end of timing interval T1, and then decreases along negative slope ramp 146 to minimum point 148 at the end of timing interval T2, and then increases along positive slope ramp 150 during the next timing interval T1. The voltage across capacitor 38 supplies the pull-up voltage for supplying current to charge capacitor 42 along quickly rising slope 136, in addition to the charging current from pin 6.

Timing interval T2 in FIG. 3 is shorter than timing interval T2 in FIG. 2. The shorter timing interval T2 in turn provides a shorter discharge time of capacitor 38 along negative slope ramp 146, such that the voltage on capacitor 38 begins to increase along positive slope ramp 150 in the next timing interval T1 from a higher minimum point 148, i.e. the voltage at point 148 in FIG. 3 is higher than the voltage at point 110 in FIG. 2. This in turn provides a higher pull-up voltage for drawing the voltage on capacitor 42 to a higher level, such that the voltage on capacitor 42 reaches the given threshold voltage 122 at an earlier time following the ignition pulse of the number one cylinder if the engine speed keeps increasing. This earlier arrival of the voltage on capacitor 142 at threshold 122 in turn cuts out ignition pulses to more of the remaining cylinders.

FIG. 4 shows engine speed above the given threshold speed. The voltage on capacitor 42 increases from minimum point 160 along positive slope ramp 162 to maximum point 164 at threshold 122, whereupon latching comparator 48 is reset and discharges capacitor 42 as shown at discharge 166. The next ignition pulse for the number one cylinder sets latching comparator 48 at pin 12 such that capacitor 42 may begin recharging as shown at 168, as pulled up by the voltage on capacitor 38. Capacitor 42 charges from capacitor 38 and output pin 6 of monostable multivibrator 30 to level 170, and then resumes its normal charging rate along positive slope ramp 172, comparably to that along ramp 162, until it reaches maximum point 174 at threshold 122, whereupon latching comparator 48 is reset, and comparator 42 discharges through pin 14 as shown at 176, and the cycle repeats.

The voltage on capacitor 38 increases from minimum point 178, FIG. 4, along positive slope ramp 180 to maximum point 182 at the end of timing interval T1, and then decreases along negative slope ramp 184 to minimum point 186 at the end of timing interval T2, and then increases again along positive slope ramp 188 during the next timing interval T1. Because of the higher engine speed in FIG. 4 as compared with FIG. 3, the voltage on capacitor 42 reaches threshold 122 at point 164 at an earlier time than point 132 in FIG. 3. At point 164, the voltage on capacitor 42 at node 46 and pin 14 resets latching comparator 48 such that output pin 9 goes high to trigger switch 50 into conduction to cut out ignition pulses to the remaining cylinders, as shown at cut out ignition pulses for cylinders 3–6, until occurrence of the next ignition pulse for the number one cylinder.

It is recognized that various equivalents, alternatives and modifications are possible within the scope of the appended claims.

I claim:

1. An overspeed control method for a multicylinder internal combustion engine having an ignition circuit supplying ignition pulses, comprising:

initiating a timing interval in response to the ignition pulse of a given cylinder;

permitting ignition pulses to the remaining cylinders during and after said timing interval, if engine speed is below a given threshold;

permitting ignition pulses to the remaining cylinders during said timing interval and cutting out ignition pulses to the remaining cylinders after said timing interval until the next occurrence of the ignition pulse for said given cylinder, if engine speed is at said threshold;

cutting out at least some of the remaining ignition pulses during said timing interval and also cutting out the remaining ignition pulses after said timing interval until the next occurrence of the ignition pulse for said given cylinder, if engine speed is above said threshold.

2. The invention according to claim 1 comprising:

charging an energy storage circuit upon initiation of said timing interval;

when the voltage in said energy storage circuit reaches a given threshold, cutting out ignition pulses to the remaining cylinders until the next occurrence of the ignition pulse for said given cylinder.

3. The invention according to claim 2 comprising:

setting a timing circuit to initiate said timing interval;

resetting said timing circuit upon termination of said timing interval;

setting a cut-out circuit in response to initiation of said timing interval to restore ignition pulses to all cylinders;

resetting said cut-out circuit upon said voltage in said energy storage circuit reaching said threshold to cut out ignition pulses to all remaining cylinders.

4. The invention according to claim 3 wherein said voltage in said energy storage circuit rises to a maximum voltage below said threshold voltage when engine speed is below said threshold speed.

5. The invention according to claim 1 comprising:

charging an energy storage circuit during said timing interval;

discharging said energy storage circuit during a second timing interval following termination of said first mentioned timing interval until the next ignition pulse of said given cylinder;

such that voltage in said energy storage circuit increases along a positive slope ramp to a maximum at the end of said first timing interval and then decreases along a negative slope ramp to a minimum at the end of said second timing interval at the next ignition pulse of said given cylinder;

such that as engine speed increases, the ignition pulses of said given cylinder become closer together in time, and said second timing interval becomes a lesser fraction of the time between ignition pulses of said given cylinder, such that the discharge time of said energy storage circuit becomes shorter, and the voltage in said energy storage circuit begins to increase along said positive slope ramp from a higher said minimum, such that voltage in said energy storage circuit reaches a given threshold at an earlier time following the ignition pulse of said given cylinder and cuts out ignition pulses to the remaining cylinders until occurrence of the next ignition pulse for said given cylinder.

6. The invention according to claim 5 comprising:

setting a timing circuit to initiate said first timing interval;

resetting said timing circuit upon termination of said first timing interval to initiate said second timing interval;

setting a cut-out circuit in response to said initiation of said first timing interval to restore ignition pulses to all cylinders;

resetting said cut-out circuit upon said voltage in said energy storage circuit reaching said given threshold to cut out ignition pulses to all remaining cylinders.

7. The invention according to claim 6 wherein said maximum voltage is below said given threshold voltage when engine speed is below said threshold speed, and wherein said maximum voltage is above said threshold voltage when engine speed is above said threshold speed, such that as engine speed increases, said second timing interval becomes a lesser fraction of the time between ignition pulses of said given cylinder, and the discharge time of said energy storage circuit becomes shorter, and said energy storage circuit discharges from a higher said maximum voltage such that said minimum voltage at the end of said second timing interval is higher, and said energy storage circuit begins increasing along said positive slope ramp from said higher minimum, to thus reach said threshold voltage at an earlier time.

8. The invention according to claim 7 wherein said first timing interval is of fixed duration.

9. An overspeed control circuit for a multicylinder internal combustion engine having an ignition circuit supplying ignition pulses, comprising:

a monostable multivibrator receiving the ignition pulse of a given cylinder and being set thereby to initiate a given timing interval of fixed duration;

a capacitor circuit responsive to the output of said monostable multivibrator and charged thereby;

a latching comparator receiving said ignition pulse of said given cylinder and being set thereby;

a cut-out switch responsive to the set state of said latching comparator and permitting ignition pulses to the cylinders;

said latching comparator also being responsive to said capacitor circuit and being reset thereby when the voltage in said capacitor circuit reaches a given threshold voltage corresponding to a given engine threshold speed;

said cut-out switch responding to the reset state of said latching comparator to cut out ignition pulses to the remaining cylinders.

10. The invention according to claim 9 wherein said monostable multivibrator and said latching comparator are provided by a dual precision monostable multivibrator integrated circuit chip, a portion of which is used as said monostable multivibrator and another portion of which is used as said latching comparator.

11. The invention according to claim 9 wherein:

said capacitor circuit comprises a first capacitor charged during said timing interval and discharged during a second timing interval following termination of said first mentioned timing interval until the next ignition pulse of said given cylinder;

the length of said first timing interval is fixed;

the length of said second timing interval is a function of engine speed;

said monostable multivibrator is reset at the end of said first timing interval;

said first capacitor is discharged during the reset state of said monostable multivibrator;

said capacitor circuit comprises a second capacitor charged by the output of said monostable multivibrator and by said first capacitor;

said latching comparator is reset when the voltage on said second capacitor reaches said threshold voltage.

12. The invention according to claim 11 wherein:

said first capacitor charges from the output of said monostable multivibrator during said first timing interval including any portion of said first timing interval after said voltage on said second capacitor reaches said threshold voltage;

said first capacitor slowly discharges through said monostable multivibrator during said second timing interval;

said second capacitor charges from the output of said monostable multivibrator and from said first capacitor during the first timing interval until said voltage on said second capacitor reaches said threshold voltage, whereupon said second capacitor quickly discharges through said latching comparator in said reset state.

13. The invention according to claim 12 wherein said second capacitor quickly charges to substantially the voltage of said first capacitor upon the next ignition pulse for said given cylinder setting said latching comparator.

14. The invention according to claim 13 wherein:

the voltage on said first capacitor increases along a positive slope ramp to a maximum at the end of said first timing interval and then decreases along a negative slope ramp to a minimum at the end of said second timing interval at the next ignition pulse for said given cylinder;

such that as engine speed increases, the ignition pulses of said given cylinder become closer together in time and said second timing interval becomes a lesser fraction of the time between ignition pulses of said given cylinder, such that the discharge time of said first capacitor becomes shorter, and the voltage on said first capacitor begins to increase along said positive slope ramp from a higher said minimum, such that voltage on said second capacitor reaches said threshold voltage at an earlier time following the ignition pulse of said given cylinder and cuts out ignition pulses to the remaining cylinders until occurrence of the next ignition pulse of said given cylinder.

15. The invention according to claim 9 wherein said cut-out switch includes a gate circuit connected through a resistor to the output of said latching comparator, and comprising a speed-up capacitor connected in parallel with said resistor and momentarily short circuiting said resistor upon said resetting of said latching comparator such that the output of said latching comparator upon being reset immediately triggers said gate circuit to actuate said cut-out switch to cut out ignition pulses to said remaining cylinders.

16. The invention according to claim 9 comprising:

a first resistor and a first capacitor connected in series between the output of said monostable multivibrator and ground such that said first capacitor is charged through said first resistor from the output of said monostable multivibrator;

a second resistor and a second capacitor connected in series from a node between said first resistor and said first capacitor and ground such that said second capacitor is charged through said first and second resistors from the output of said monostable multivibrator;

the node between said second resistor and said second capacitor being connected to the reset input of said latching comparator;

said first capacitor being substantially larger than said second capacitor such that said first capacitor is charged during said first timing interval and stores most of the energy providing said voltage for comparison against said threshold voltage;

upon termination of said first timing interval, said first capacitor slowly discharges through said monostable multivibrator;

said latching comparator being reset when the voltage on said second capacitor reaches said threshold voltage whereupon said second capacitor quickly discharges through said latching comparator and enables fast response and quick setting of said latching comparator in response to the next ignition pulse of said given cylinder, to restore ignition pulses.

17. The invention according to claim 16 wherein said second resistor is substantially larger than said first resistor such that said first capacitor discharges mainly through said first resistor and said monostable multivibrator rather than through said second resistor and said latching comparator.

* * * * *